US012358098B2

(12) United States Patent
Yamaguchi et al.

(10) Patent No.: US 12,358,098 B2
(45) Date of Patent: Jul. 15, 2025

(54) LIQUID FEEDER AND POLISHING APPARATUS

(71) Applicant: EBARA CORPORATION, Tokyo (JP)

(72) Inventors: Kuniaki Yamaguchi, Tokyo (JP); Masayuki Tamura, Tokyo (JP); Kenji Shinkai, Tokyo (JP); Soichi Isobe, Tokyo (JP); Yusuke Mochida, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 280 days.

(21) Appl. No.: 17/809,074

(22) Filed: Jun. 27, 2022

(65) Prior Publication Data

US 2023/0001539 A1 Jan. 5, 2023

(30) Foreign Application Priority Data

Jun. 30, 2021 (JP) ..... 2021-108709

(51) Int. Cl.
*B24B 53/00* (2006.01)
*B24B 53/017* (2012.01)
*B24B 57/02* (2006.01)

(52) U.S. Cl.
CPC ..... *B24B 53/003* (2013.01); *B24B 53/017* (2013.01); *B24B 57/02* (2013.01)

(58) Field of Classification Search
CPC ..... B24B 53/003; B24B 53/017; B24B 57/02; B24B 37/34; B24B 37/005; B24B 37/015; B24B 53/005; B24B 55/02; B24B 55/03; H01L 21/67092
USPC ..... 451/443, 444, 446, 449
See application file for complete search history.

(56) References Cited

U.S. PATENT DOCUMENTS 5,893,753 A * 4/1999 Hempel, Jr. ..... B24B 37/042 438/693
6,385,805 B2 * 5/2002 Konishi ..... B08B 1/36 134/902
6,643,882 B1 11/2003 Sotozaki et al.
7,891,935 B2 * 2/2011 Kremerman ..... B25J 9/044 414/744.5

(Continued)

FOREIGN PATENT DOCUMENTS

CN 114536224 A 5/2022
JP 2002-299293 A 10/2002

(Continued)

*Primary Examiner* — Eric J Rosen
*Assistant Examiner* — Christopher Soto
(74) *Attorney, Agent, or Firm* — Chrisman Gallo Tochtrop LLC

(57) ABSTRACT

A liquid feeder includes: a first arm having a first nozzle; a second arm having a second nozzle; a first rotation shaft supporting a proximal end part of the first arm; a second rotation shaft supporting a proximal end part of the second arm; a first rotation driver configured to rotate the first rotation shaft to turn the first arm from a fluid feed position to a retracted position; a second rotation driver configured to rotate the second rotation shaft to turn the second arm from a fluid feed position to a retracted position; and a controller. The first rotation shaft and the second rotation shaft are disposed coaxially with each other. The controller is capable of controlling the operation of the first rotation driver and the operation of the second rotation driver independently of each other.

14 Claims, 7 Drawing Sheets

(56) References Cited

U.S. PATENT DOCUMENTS

| | | | | |
|---|---|---|---|---|
| 2002/0177320 | A1 | 11/2002 | Jae et al. | |
| 2009/0136670 | A1* | 5/2009 | Choi | H01L 21/6708 118/313 |
| 2010/0041316 | A1* | 2/2010 | Wang | B24B 37/042 451/37 |
| 2018/0001440 | A1 | 1/2018 | Aono et al. | |
| 2018/0012780 | A1 | 1/2018 | Shinozaki et al. | |

FOREIGN PATENT DOCUMENTS

| | | | |
|---|---|---|---|
| JP | 2006-150291 | A | 6/2006 |
| JP | 2011-530422 | A | 12/2011 |
| JP | 2018-006549 | A | 1/2018 |
| WO | 2010/019264 | A1 | 2/2010 |

* cited by examiner

SWING ANGLE θ2

COMPARATIVE EXAMPLE

LIQUID FEEDER AND POLISHING APPARATUS

CROSS-REFERENCE TO RELATED APPLICATIONS

This application claims the benefit of Japanese Priority Patent Application JP 2021-108709 filed on Jun. 30, 2021, the entire contents of which are incorporated herein by reference.

FIELD

The present technique relates to a liquid feeder and a polishing apparatus.

BACKGROUND AND SUMMARY

With the progress of higher levels of integration in semiconductor devices in recent years, circuit wiring is becoming finer, and an inter-wiring distance is becoming narrower. In the manufacture of semiconductor devices, many kinds of materials are repeatedly formed in a film shape on a silicon wafer to form a layered structure. In order to form this layered structure, a technique to planarize the surface of the wafer is essential. As such means for planarizing the surface of a wafer, polishing apparatuses that perform chemical mechanical polishing (CMP) (also referred to as chemical mechanical polishing apparatuses) are widely used.

Typically, a chemical mechanical polishing (CMP) apparatus includes a polishing table with a polishing pad attached thereto, a top ring (polishing head) for holding a wafer, and a slurry ejection nozzle for feeding a polishing liquid (slurry) onto the polishing pad. While the polishing liquid is fed onto the polishing pad from the slurry ejection nozzle, the top ring presses the wafer against the polishing pad, and the top ring and the polishing table are moved relative to each other, thereby polishing the wafer to planarize the surface of the wafer.

After the wafer is polished, particles such as polishing debris and abrasive grains contained in the polishing liquid remain on the polishing pad. Thus, after the wafer is polished, an atomizer having at least one jet nozzle that jets liquid or a gas-liquid fluid mixture toward the polishing pad sprays a mist-like cleaning fluid (liquid or a liquid-gas mixture) onto the polishing pad to remove foreign substances on the polishing pad.

In conventional apparatuses, in moving a slurry ejection nozzle provided on the distal end part of a swing arm between a slurry dropping position and a retracted position, the slurry ejection nozzle interferes with an atomizer positioned above a polishing pad, which limits the operation range of the swing arm and the height of the slurry ejection nozzle. Thus, it is difficult to drop slurry required to polish a wafer onto an optimum position at an optimum timing.

Japanese Patent Laid-Open No. 2018-6549 discloses a technique that includes a swing arm configured to be rotatable around a horizontal axis extending in the horizontal direction and rotates the swing arm around the horizontal axis in moving a slurry ejection nozzle between a slurry dropping position and a retracted position to retract the slurry ejection nozzle above an atomizer.

The polishing apparatus requires, on and above the polishing pad, a space for installing a device other than the slurry ejection nozzle and the atomizer, such as a dresser for dressing the polishing pad or a temperature control slider for controlling the surface temperature of the polishing pad. However, in conventional apparatuses, a large space is required for the swing arm swinging above the polishing pad and for installing a device such as a dresser or a temperature control slider on and above the polishing pad, and it is difficult to leave a space for the atomizer to swing.

Also, as described above, in conventional apparatuses, the slurry ejection nozzle provided on the distal end part of the swing arm interferes with the atomizer positioned above the polishing pad, which limits the operation range of the swing arm. Thus, it is difficult to drop slurry required to polish a wafer onto an optimum position at an optimum timing.

Furthermore, in conventional apparatuses, jetted water (water droplets) unpredictably dripping after the polishing pad is cleaned by the atomizer positioned above the polishing pad may dilute the slurry fed onto the polishing pad during polishing and thus change the amount of polishing per unit slurry, which may increase the consumption of expensive slurry.

It is desirable to provide a liquid feeder and a polishing apparatus that can leave a space for installing a device other than a first nozzle and a second nozzle on and above a polishing table and retract at least one of the first nozzle and the second nozzle from the polishing table at any timing.

A liquid feeder according to an aspect of the present technique includes:

- a first arm having a first nozzle configured to eject a first fluid onto a polishing table;
- a second arm having a second nozzle configured to eject a second fluid onto the polishing table;
- a first rotation shaft supporting a proximal end part of the first arm;
- a second rotation shaft supporting a proximal end part of the second arm;
- a first rotation driver configured to rotate the first rotation shaft around an axis thereof to turn the first arm from a fluid feed position inside the polishing table to a retracted position outside the polishing table;
- a second rotation driver configured to rotate the second rotation shaft around an axis thereof to turn the second arm from a fluid feed position inside the polishing table to a retracted position outside the polishing table; and
- a controller configured to control an operation of the first rotation driver and an operation of the second rotation driver, in which
- the first rotation shaft and the second rotation shaft are disposed coaxially with each other, and
- the controller is capable of controlling the operation of the first rotation driver and the operation of the second rotation driver independently of each other.

DETAILED DESCRIPTION OF NON-LIMITING EXAMPLE EMBODIMENTS

Figure 1:
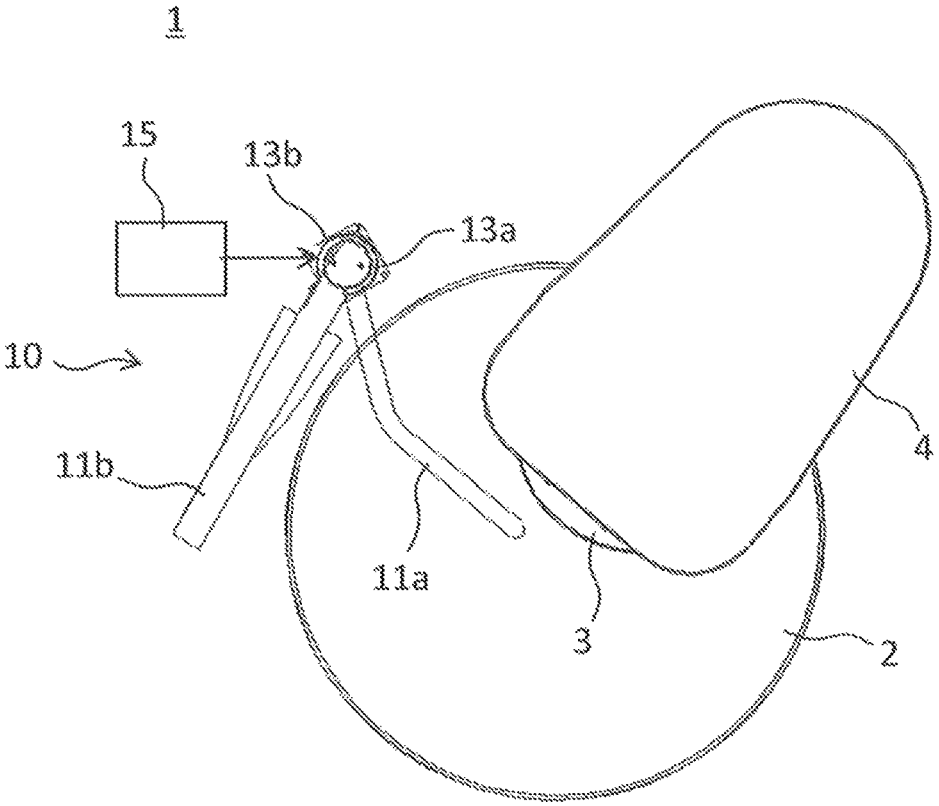
FIG. 1 is a plan view illustrating the schematic configuration of a polishing apparatus according to an embodiment.

A liquid feeder according to a first aspect of an embodiment includes:

a first arm having a first nozzle configured to eject a first fluid onto a polishing table;

a second arm having a second nozzle configured to eject a second fluid onto the polishing table;

a first rotation shaft supporting a proximal end part of the first arm;

a second rotation shaft supporting a proximal end part of the second arm;

a first rotation driver configured to rotate the first rotation shaft around an axis thereof to turn the first arm from a fluid feed position inside the polishing table to a retracted position outside the polishing table;

a second rotation driver configured to rotate the second rotation shaft around an axis thereof to turn the second arm from a fluid feed position inside the polishing table to a retracted position outside the polishing table; and a controller configured to control an operation of the first rotation driver and an operation of the second rotation driver, in which the first rotation shaft and the second rotation shaft are disposed coaxially with each other, and the controller is capable of controlling the operation of the first rotation driver and the operation of the second rotation driver independently of each other.

According to such an aspect, since the first rotation shaft and the second rotation shaft are disposed coaxially with each other, the first arm and the second arm are turned around the same axis. This can minimize a space occupied by the first arm and the second arm turning above the polishing table, thereby leaving a space for installing a device other than the first nozzle and the second nozzle on and above the polishing table. Also, since the operation of the first rotation driver and the operation of the second rotation driver can be controlled independently of each other, at least one of the first nozzle and the second nozzle can be retracted from the polishing table at any timing by individually driving the first arm and the second arm. For example, in a case where the first nozzle is a slurry ejection nozzle, and the second nozzle is an atomizer, the atomizer is retracted in advance out of the polishing table in ejecting slurry from the slurry ejection nozzle while swinging the swingarm. This prevents the operation range of the swingarm from being limited by interference with the atomizer to enable the slurry to be dropped onto the entire surface of the pad and also prevents the slurry fed onto the polishing pad from being diluted with jetted water (water droplets) unpredictably dripping from the atomizer. Thus, the polishing performance is improved.

A liquid feeder according to a second aspect of the embodiment is the liquid feeder according to the first aspect, in which the first arm and the second arm are disposed at different height positions.

According to such an aspect, the first arm and the second arm can be turned so as to cross each other. Thus, each of the first nozzle and the second nozzle can be retracted from the polishing table at any timing.

A liquid feeder according to a third aspect of the embodiment is the liquid feeder according to the first or second aspect, in which the first fluid is one or more of an abrasive liquid, a chemical solution, pure water, nitrogen, and compressed air, and the second fluid is one or more of an abrasive liquid, a chemical solution, pure water, nitrogen, and compressed air.

A liquid feeder according to a fourth aspect of the embodiment is the liquid feeder according to any one of the first to third aspects, in which the first nozzle has a plurality of ejection orifices, and/or the second nozzle has a plurality of ejection orifices.

A liquid feeder according to a fifth aspect of the embodiment is the liquid feeder according to any one of the first to fourth aspects, in which the controller is capable of controlling ejection of the first fluid from the first nozzle and ejection of the second fluid from the second nozzle independently of each other.

A liquid feeder according to a sixth aspect of the embodiment is the liquid feeder according to any one of the first to fifth aspects, in which the controller is capable of feeding the first fluid from the first nozzle regardless of a position of the first arm and capable of feeding the second fluid from the second nozzle regardless of a position of the second arm.

A liquid feeder according to a seventh aspect of the embodiment is the liquid feeder according to any one of the first to sixth aspects, in which the controller is capable of ejecting the first fluid from the first nozzle while swinging the first arm and capable of ejecting the second fluid from the second nozzle while swinging the second arm.

A polishing apparatus according to an eighth aspect of the embodiment includes the liquid feeder according to any one of the first to seventh aspects.

Hereinbelow, specific examples of the embodiment will be described with reference to the drawings. Note that, in the following description and the drawings used in the following description, parts that can be configured in the same manner will be designated by the same reference sign, and redundant description thereof will be omitted.

(Apparatus Configuration)

FIG. 1 is a plan view illustrating the schematic configuration of a polishingapparatus1 according to an embodiment.

As illustrated in FIG. 1, the polishingapparatus1 includes a polishing table 2 with a polishing pad (not illustrated) attached thereto, a top ring (polishing head) 3 for holding a wafer (not illustrated) and polishing the wafer while pressing the wafer against the polishing pad on the polishing table 2, and a liquid feeder 10.

Among these, the top ring 3 is supported by a top ring head 4. The polishing pad (not illustrated) is stuck onto the upper face of the polishing table 2. The upper face of the polishing pad constitutes a polishing surface that polishes a wafer. Note that a fixed grindstone can also be used instead of the polishing pad. The top ring 3 and the polishing table 2 are configured to be rotatable around their axes. The wafer is held on the lower face of the top ring 3 by vacuum suction. During polishing, a polishing liquid (slurry) is fed to the polishing surface of the polishing pad from the liquid feeder 10, and the wafer to be polished is pressed by the top ring 3 against the polishing surface and thus polished.

Figure 2:
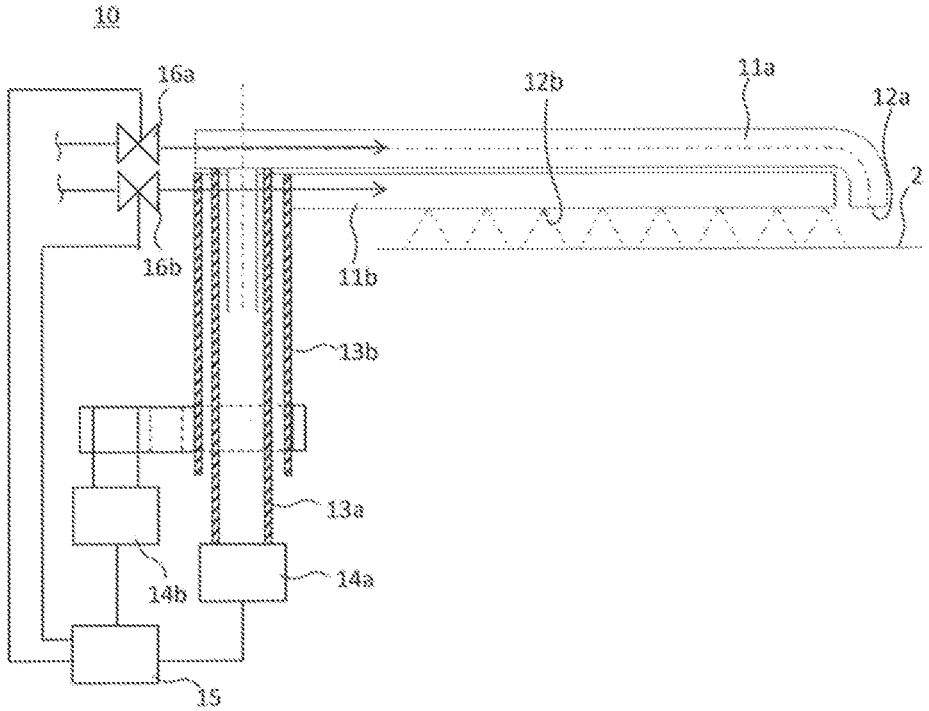
FIG. 2 is a longitudinal sectional view illustrating, in an enlarged manner, a liquid feeder included in the polishing apparatus illustrated in FIG. 1.

FIG. 2 is a longitudinal sectional view illustrating, in an enlarged manner, the liquid feeder 10.

As illustrated in FIGS. 1 and 2, the liquid feeder 10 includes a first arm 11*a* and a second arm 11*b*, a first rotation shaft 13*a* and a second rotation shaft 13*b*, a first rotation driver 14*a* and a second rotation driver 14*b*, and a controller 15.

Among these, the first arm 11*a* is disposed in such a manner as to horizontally extend above the polishingtable2. The proximal end part of the first arm 11*a* is fixed to and supported by the first rotation shaft 13*a*.

The first arm 11*a* has a first nozzle 12*a* configured to eject a first fluid onto the polishing table 2. The first nozzle 12*a* may have a plurality of ejection orifices. The number of ejection orifices of the first nozzle 12*a* is four in the present embodiment, but not limited thereto. The number of ejection orifices of the first nozzle 12*a* may be one to three or five or more. The number of ejection orifices of the first nozzle 12*a* can be increased as long as ejection onto the polishing table 2 can be performed. In the illustrated example, the ejection orifices of the first nozzle 12*a* are positioned at the distal end part of the first arm 11*a*. The first fluid supplied from a first fluid supply source (not illustrated) is fed to each of the ejection orifices of the first nozzle 12*a* through a first valve 16*a*, which is openable and closable. The first fluid is not limited to any particular kind of fluid and may be, for example, one or more of an abrasive liquid, a chemical solution, pure water, nitrogen, and compressed air.

In the illustrated example, the first rotation driver 14*a* is provided on the lower end part of the first rotation shaft 13*a*. The driving system of the first rotation driver 14*a* is not limited to any particular system. For example, the first rotation driver 14*a* may be any of a motor, an electric cylinder, an air cylinder, a hollow direct drive (DD) motor, and a hollow rotary actuator. The first rotation driver 14*a* rotates the first rotation shaft 13*a* around the axis extending in the vertical direction to move the first arm 11*a* fixed to the first rotation shaft 13*a* from a fluid feed position set inside the polishing table 2 to a retracted position set outside the polishing table 2 in plan view (turns the first arm 11*a* around the axis of the first rotation shaft 13*a*).

The second arm 11*b* is disposed in such a manner as to horizontally extend above the polishingtable2. The proximal end part of the second arm 11*b* is fixed to and supported by the second rotation shaft 13*b*.

The second arm 11*b* has a second nozzle 12*b* configured to eject a second fluid onto the polishing table 2. The second nozzle 12*b* may have a plurality of ejection orifices. The number of ejection orifices of the second nozzle 12*b* is eight in the present embodiment, but not limited thereto. The number of ejection orifices of the second nozzle 12*b* may be one to seven or nine or more. The number of ejection orifices of the second nozzle 12*b* can be increased as long as ejection onto the polishing table 2 can be performed. In the illustrated example, the ejection orifices of the second nozzle 12*b* are evenly spaced in the longitudinal direction of the second arm 11*b*. The second fluid supplied from a second fluid supply source (not illustrated) is fed to each of the ejection orifices of the second nozzle 12*b* through a second valve 16*b*, which is openable and closable. The second fluid is not limited to any particular kind of fluid and may be, for example, one or more of an abrasive liquid, a chemical solution, pure water, nitrogen, and compressed air.

In the illustrated example, the secondrotationdriver14*b* is disposed adjacent to the lower end part of the second rotation shaft 13*b* and connected to the second rotation shaft 13*b* through a pulley and a belt. The driving system of the second rotation driver 14*b* is not limited to any particular system. For example, the second rotation driver 14*b* may be any of a motor, an electric cylinder, an air cylinder, a hollow direct drive (DD) motor, and a hollow rotary actuator. The second rotation driver 14*b* rotates the second rotation shaft 13*b* around the axis extending in the vertical direction to move the second arm 11*b* fixed to the second rotation shaft 13*b* from a fluid feed position set inside the polishing table 2 to a retracted position set outside the polishing table 2 in plan view (turns the second arm 11*b* around the axis of the second rotation shaft 13*b*).

In the present embodiment, the first nozzle 12*a* is a standard slurry ejection nozzle having the four ejection orifices and ejects an abrasive liquid, pure water, and a dispersant from the different ejection orifices, and the second nozzle 12*b* is an atomizer having the eight ejection orifices and sequentially ejects (jets) pure water and nitrogen from each of the ejection orifices. Note that the first nozzle 12*a* and the second nozzle 12*b* are not limited to the combination of the standard slurry ejection nozzle and the atomizer. As one modification, the first nozzle 12*a* may be a slurry multi-nozzle (multipoint liquid ejection nozzle) having eight ejection orifices, and the second nozzle 12*b* may be an atomizer. For example, the technique described in Japanese Patent Application No. 2020-038725 of the applicant of the present application can be applied to the slurry multi-nozzle (multipoint liquid ejection nozzle). As another modification, the first nozzle 12*a* and the second nozzle 12*b* may both be standard slurry ejection nozzles. As still another modification, the first nozzle 12*a* and the second nozzle 12*b* may both be atomizers.

The first nozzle 12*a* and the second nozzle 12*b* may be configured to eject a temperature-controlled fluid. As a first example, the first nozzle 12*a* and the second nozzle 12*b* may eject a heated fluid (for example, the first fluid is a warm abrasive liquid (up to 80° C.), and the second fluid is warm pure water (up to 80° C.)) so as to maintain the temperature of the polishing table 2 uniform. In this case, a temperature control slider or the like (not illustrated) disposed on the polishing table 2 may be additionally used. For example, the technique described in Japanese Patent Laid-Open No. 2018-030181 of the applicant of the present application can be applied to the temperature control slider. A temperature sensor may be mounted on the ceiling of a polishing chamber to monitor the temperature of the polishing table 2. The temperature control on the first fluid and the second fluid may be performed outside the polishing chamber.

As a second example, the first nozzle 12*a* and the second nozzle 12*b* may eject a fluid for cooling (for example, the first fluid and the second fluid are both a fluid having a temperature of approximately up to 30° C.) to prevent a temperature rise in the polishing table 2. In this case, a pad cooling nozzle or the like (not illustrated) disposed above the polishing table 2 may be additionally used. For example, the technique described in Japanese Patent Laid-Open No. 2018-030181 of the applicant of the present application can be applied to the pad cooling nozzle. Also, as with the first example, a temperature sensor may be mounted on the ceiling of the polishing chamber to monitor the temperature of the polishing table 2, and the temperature control on the first fluid and the second fluid may be performed outside the polishing chamber.

In the present embodiment, as illustrated in FIGS. 1 and 2, the first rotation shaft 13*a* and the second rotation shaft 13*b* are disposed coaxially with each other. In the illustrated example, the first rotation shaft 13*a* is coaxially disposed inside the second rotation shaft 13*b*. However, the positions of the first rotation shaft 13*a* and the second rotation shaft 13*b* are not limited thereto, and the second rotation shaft 13*b* may be coaxially disposed inside the first rotation shaft 13*a*. Note that, in the present specification, the first rotation shaft 13*a* and the second rotation shaft 13*b* disposed "coaxially" with each other means, in other words, that the rotation center of the first rotation shaft 13*a* and the rotation center of the second rotation shaft 13*b* coincide with each other.

As illustrated in FIG. 2, the first arm 11*a* and the second arm 11*b* may be disposed at different height positions. In the illustrated example, the upper end part of the first rotation shaft 13*a* projects and is thus exposed above the upper end part of the second rotation shaft 13*b*, and the proximal end part of the first arm 11*a* is fixed to and supported on the upper end part of the first rotation shaft 13*a*. Accordingly, the first arm 11*a* is disposed at the height position higher than the secondarm11*b*. As an unillustrated modification, the second rotation shaft 13*b* may have, on the peripheral face thereof, a cutout extending in the circumferential direction so that a part of the peripheral face of the first rotation shaft 13*a* is exposed to the outside through the cutout of the second rotation shaft 13*b*, and the proximal end part of the first arm 11*a* may be fixed to and supported on the peripheral face of the first rotation shaft 13*a* through the cutout of the second rotation shaft 13*b*. In this case, the first arm 11*a* is disposed at a height position lower than the secondarm11*b*.

Since the first rotation shaft 13*a* and the second rotation shaft 13*b* are disposed coaxially with each other, the first arm 11*a* and the second arm 11*b* are turned around the same axis. This can minimize a space occupied by the first arm 11*a* and the second arm 11*b* turning above the polishing table 2, thereby leaving a space for installing a device other than the first nozzle 12*a* and the second nozzle 12*b* (for example, a dresser (not illustrated), the above-described temperature control slider, or the above-described pad cooling nozzle) on and above the polishing table 2.

As illustrated in FIG. 2, the distal end of the second arm 11*b* may be located inside the position of the first nozzle 12*a* (that is, on the side closer to the rotation shafts 13*a* and 13*b* than the first nozzle 12*a* is). In this case, aspacebetweenthefirstnozzle12*a*andthepolishingtable2 canbereduced (that is, the necessity of increasing the height of the first nozzle 12*a* to avoid the second arm 11*b* is eliminated).

The controller 15 includes one or more computers. The controller 15 is capable of controlling the operation of the first rotation driver 14*a* and the operation of the second rotation driver 14*b* independently of each other (that is, controlling the operation of one regardless of whether the other is in operation) by separately transmitting control signals to the first rotation driver 14*a* and the second rotation driver 14*b*. Also, the controller 15 may be capable of controlling the ejection of the first fluid from the first nozzle 12*a* and the ejection of the second fluid from the second nozzle 12*b* independently of each other (that is, controlling the ejection from one regardless of whether the ejection from the other is being performed) by separately transmitting control signals to the first valve 16*a* and the second valve 16*b*.

By controlling the operation of the first rotation driver 14*a* and the second rotation driver 14*b* independently of each other to individually drive the first arm 11*a* and the second arm 11*b*, at least one of the first nozzle 12*a* and the second nozzle 12*b* can be retracted from the polishing table 2 at any timing. For example, in a case where the first nozzle 12*a* is a slurry ejection nozzle, and the second nozzle 12*b* is an atomizer, the atomizer 12*b* is retracted in advance from the polishing table 2 in ejecting slurry from the slurry ejection nozzle 12*a* while swinging the first arm 11*a*. This prevents the operation range of the first arm 11*a* from being limited by interference with the atomizer 12*b* to enable the slurry to be dropped onto the entire surface of the pad and also prevents the slurry fed onto the polishing pad from being diluted with jetted water (water droplets)unpredictably dripping from the atomizer 12*b*. Thus, the polishing performance can be improved.

Furthermore, in the present embodiment, the first arm 11*a* and the second arm 11*b* are disposed at the different height positions. Thus, in turning the first arm 11*a* and the second arm 11*b* around the same axis, the first arm 11*a* and the second arm 11*b* can be turned so as to cross each other (that is, so that one passes above (or below) the other). This makes it possible to retract each of the first nozzle 12*a* and the second nozzle 12*b* from the polishing table 2 at any timing (that is, retract one regardless of the position of the other).

The advantages of retracting the firstnozzle12*a*andthesecondnozzle12*b* at any timing are as follows. That is, a preliminary preparation including the following operations (1) to (5) can be performed at the retracted position at any timing.

(1) Discharging fluid (e.g., slurry) remaining inside a pipe
(2) Flushing (cleaning) the inside of the pipe with pure water
(3) Preloading fluid (e.g., slurry) (a preparation operation for making fluid ready to be ejected from the ejection orifices at any time)
(4) Cleaning the nozzle tip (ejection orifices) or the nozzle body using cleaning means (not illustrated) provided at the retracted position
(5) In a case where the nozzle is an atomizer, cleaning a device located at the retracted position (for example, a device that gets dirt with slurry dropped from the slurry nozzle when the slurry nozzle is retracted) using the atomizer The operations of (1) to (5) are typical factors that reduce a polishing time (wafer processing time). However, by retracting each of the first nozzle 12*a* and the second nozzle 12*b* out of the polishing table 2 at any timing, the above operations (1) to (5) canbeperformedontheretractednozzleduringanidletime whiletheunretractednozzleisoperatingabovethepolishingtable2. This reduces reduction in the polishing time (wafer processing time).

Figure 3:
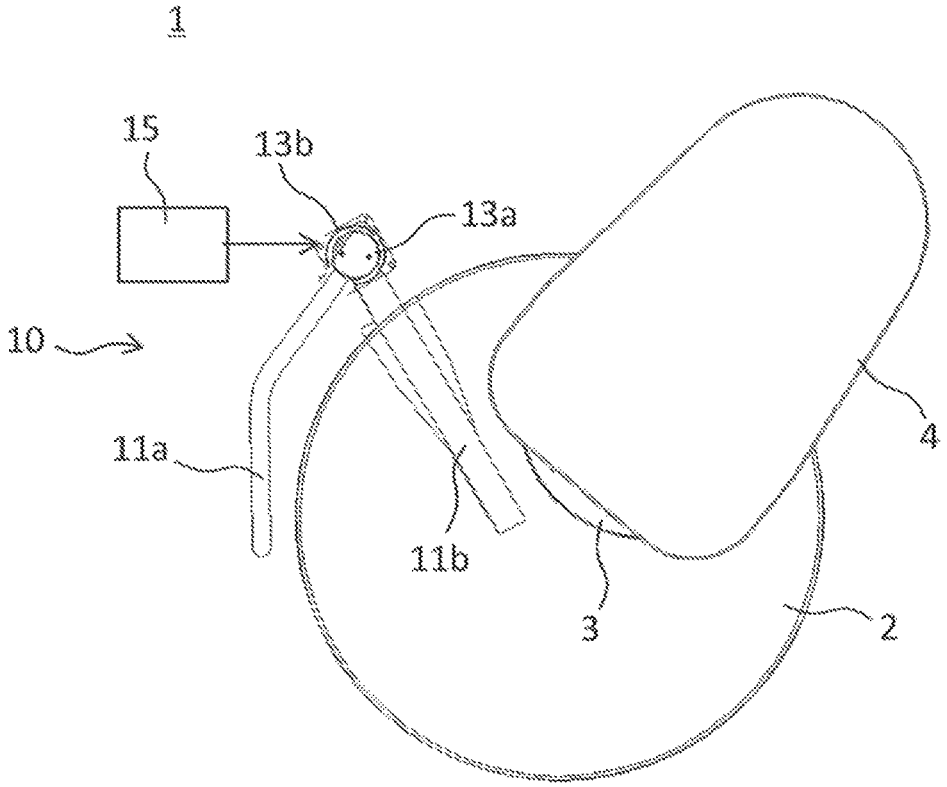
FIG. 3 is a plan view illustrating positioning of a first arm and a second arm during table cleaning before and after polishing.
Figure 4:
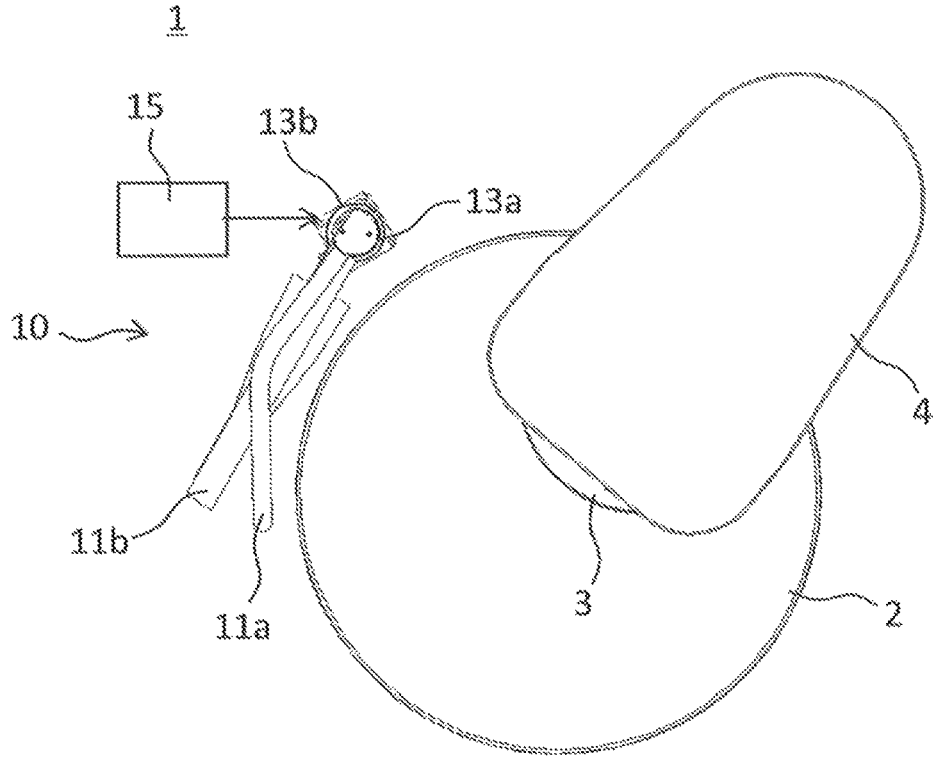
FIG. 4 is a plan view illustrating positioning of the first arm and the second arm during maintenance.

FIG. 3 is a plan view illustrating positioning of the first arm 11*a* and the secondarm11*b* during table cleaning before and after polishing in a mode in which the first nozzle 12*a* is a slurry ejection nozzle and the second nozzle 12*b* is an atomizer. FIG. 4 is a plan view illustrating positioning of thefirstarm11*a*andthesecondarm11*b* during maintenance. As illustrated in FIG. 3, during table cleaning, the second arm 11*b* is positioned at the fluid ejection position inside the polishing table 2, and the first arm 11*a* is positioned at the retracted position outside the polishing table 2. Also, as illustrated in FIG. 4, during maintenance, the first arm 11*a* and the second arm 11*b* are both positioned at the retracted positions outside the polishing table 2.

The controller 15 may be capable of feeding the first fluid from the first nozzle 12*a* by transmitting a control signal to the first valve 16*a* regardless of the position of the first arm 11*a* (that is, even when the first arm 11*a* is located at a position other than the predetermined liquid ejection position) and may be capable of feeding the second fluid from the second nozzle 12*b* by transmitting a control signal to the second valve 16*b* regardless of the position of the second arm 11*b* (that is, even when the second arm 11*b* is located at a position other than the predetermined liquid ejection position). Accordingly, each of the first nozzle 12*a* and the second nozzle 12*b* can eject the fluid at any timing. For example, in a case where the first nozzle 12*a* is a slurry ejection nozzle and the second nozzle 12*b* is an atomizer, a cleaning liquid can be jetted from the atomizer 12*b* to clean the polishing table 2 in a state where the second arm 11*b* is positioned at the cleaning liquid ejection position inside the polishing table 2 and, at the same time, slurry can be jetted from the slurry ejection nozzle 12*a* to perform preload in a state where thefirstarm11*a* is positioned at the retracted position outside the polishing table 2.

The controller 15 may be capable of ejecting the first fluid from thefirstnozzle12*a* while swinging the first arm 11*a* and/or capable of ejecting the second fluid from thesecondnozzle12*b* while swinging the second arm 11*b*.

Figure 5:
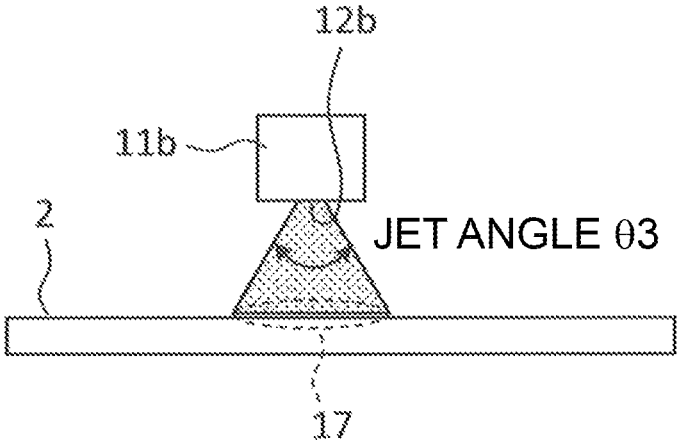
FIG. 5 is a side view illustrating a jet angle of a second nozzle.
Figure 6:
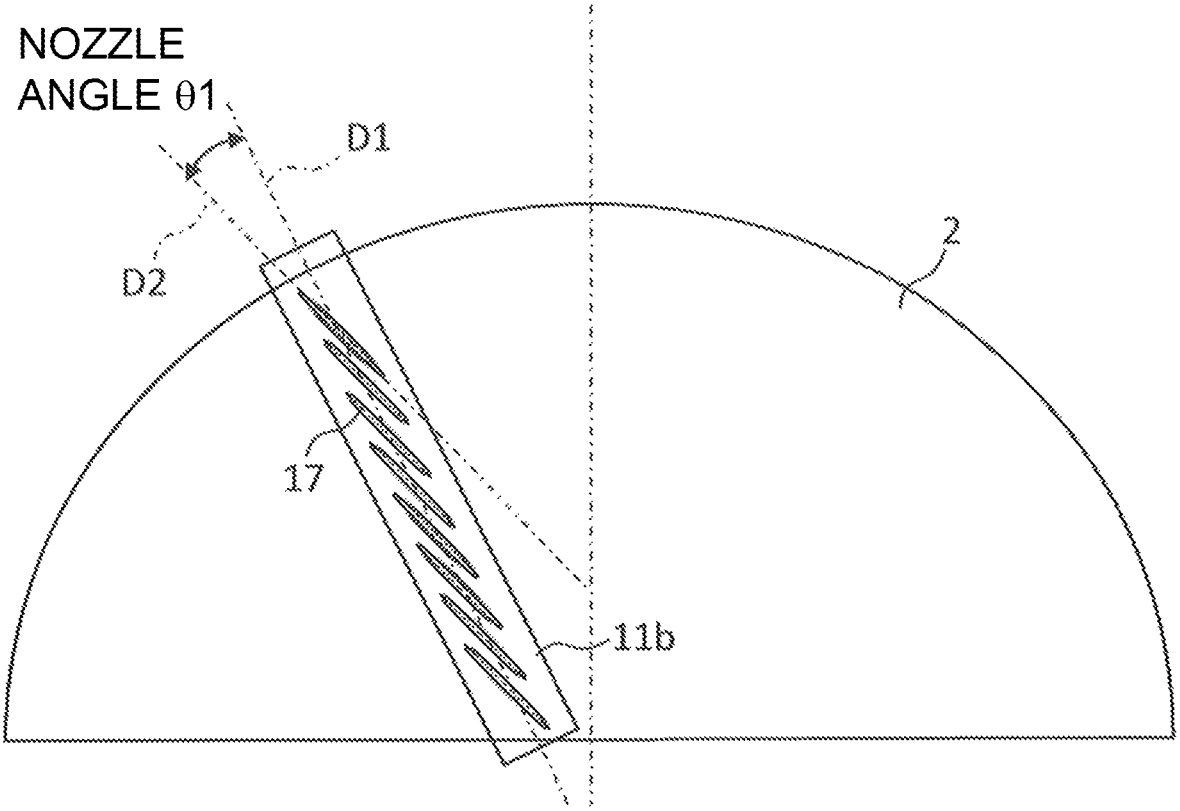
FIG. 6 is a plan view illustrating positioning of the second nozzle.
Figure 7:
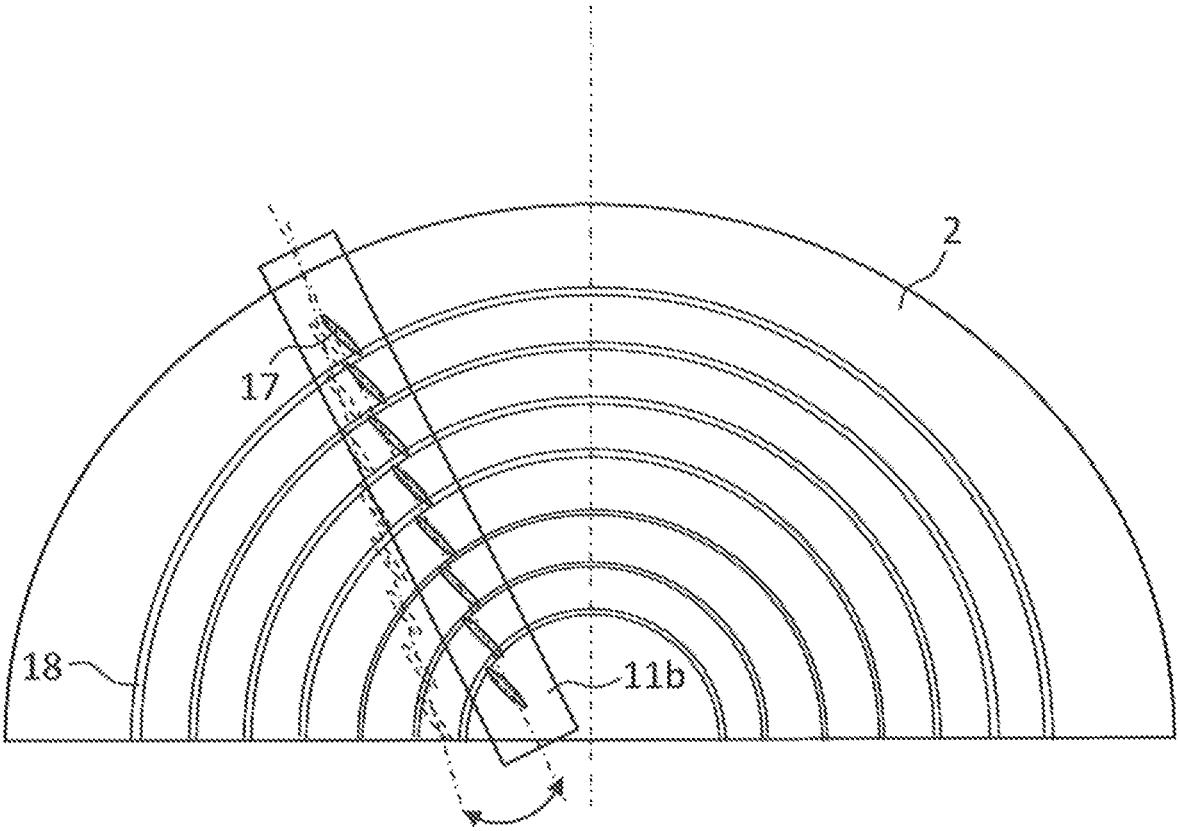
FIG. 7 is a plan view illustrating gaps (remaining streaks) produced betweenejectionorificesofthesecondnozzle.

Referring to FIGS. 5 to 7, the advantages of ejecting, in a case where the second nozzle 12*b* is an atomizer, the second fluid from the atomizer 12*b* while swinging the second arm 11*b* will be described.

As illustrated in FIG. 5, each ejection orifice of the atomizer 12*b* has a slit shape, and the second fluid ejected (jetted) from each ejection orifice expands at a jet angle θ3 and lands on the polishing table 2. Thus, a landing area 17 of the second fluid on the polishing table 2 has an elongated shape as illustrated in FIG. 6. As illustrated in FIG. 5, a longitudinal direction D2 of each ejection orifice having a slit shape is inclined by a nozzle angle θ1 (e.g., 30° to 60°) relative to a longitudinal direction D1 of the second arm 11*b* so that the longitudinal ends of the adjacent landing areas 17 overlap in the radial direction of the polishing table 2 in a state where the second arm 11*b* is positioned at the predetermined fluid feed position. In this case, in theory, when the longitudinal ends of the adjacent landing areas 17 overlap in the radial direction of the polishing table 2 in a state where the second arm 11*b* is positioned at the predetermined fluid feed position, the second fluid can be fed to the entire surface of the rotating polishing table 2 (with no gap).

However, in reality, as the pressure of the second fluid fed to the atomizer 12*b* decreases, the jet angle θ3 of the second fluid ejected (jetted) from each ejection orifice becomes narrower. Thus, as illustrated in FIG. 7, the length of each landing area 17 of the second fluid on the polishing table 2 becomes shorter. As a result, the longitudinal ends of the adjacent landing areas 17 may not overlap in the radial direction of the polishing table 2 (gaps are produced) in a state where the second arm 11*b* is positioned at the predetermined fluid feed position, and areas to which the second fluid is not fed may remain in a streak form (remaining streaks 18 may be produced) on the rotating polishing table 2.

On the other hand, in the present embodiment, by ejecting the second fluid from the secondnozzle(atomizer)12*b* while swinging the second arm 11*b* at a swing angle θ2 (e.g., 1° to 45°), it is possible to allow the landing areas 17 to overlap the remaining streaks 18 even if the jet angle θ3 decreases. Thus, it is possible to feed the second fluid to the entire surface of the polishing table 2 (with no gap) to maintain the entire surface cleaning.

(Example of Operation)

Figure 8:
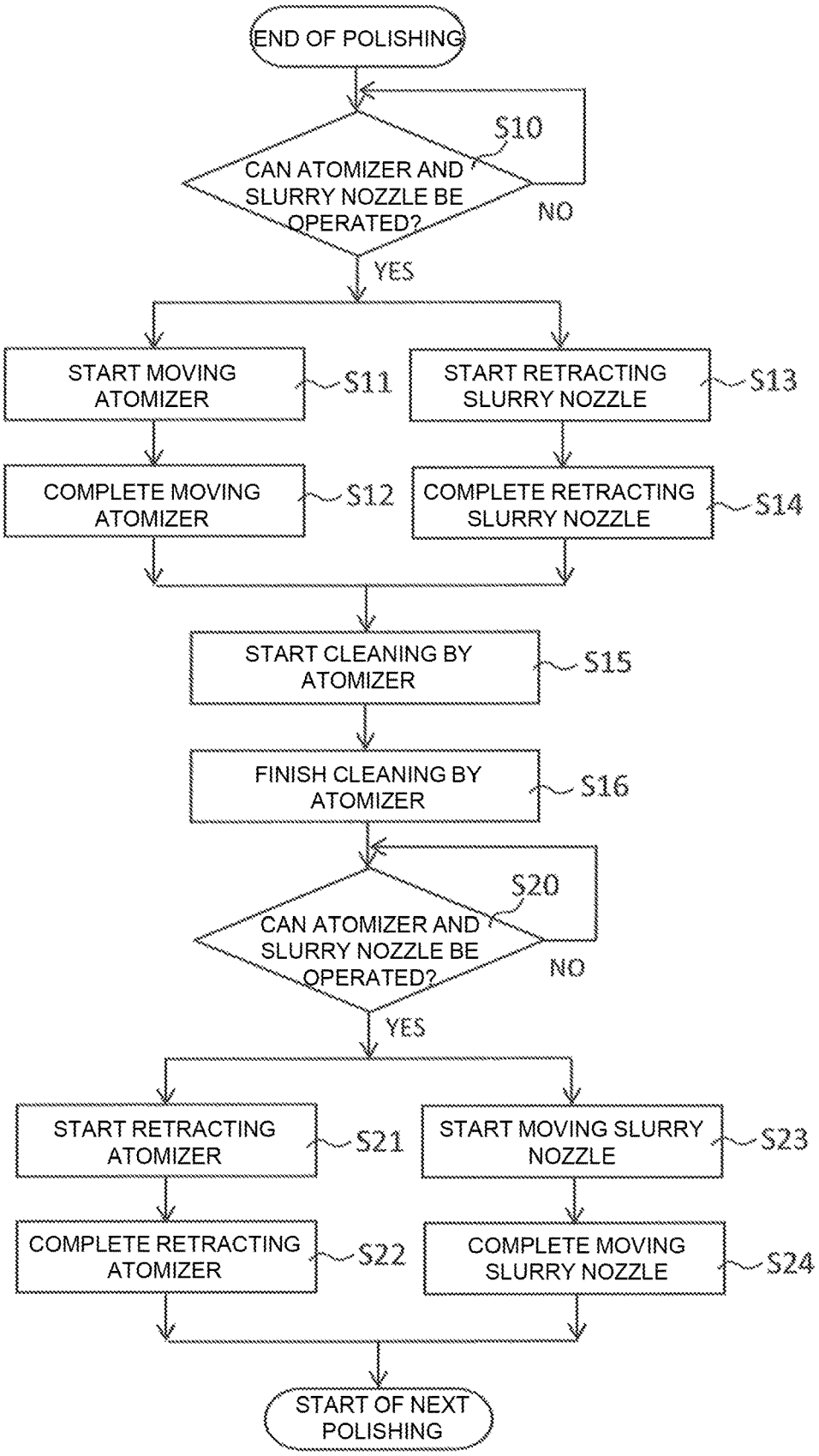
FIG. 8 is a flowchart illustrating an example of the operation of the polishing apparatus according to the embodiment.

Next, an example of the operation of the polishing apparatus 1 will be described with reference to FIG. 8. FIG. 8 is a flowchart illustrating an example of the operation of the polishing apparatus 1. Hereinbelow, a mode in which the first nozzle 12*a* is a slurry ejection nozzle and the second nozzle 12*b* is an atomizer will be described as an example.

First, in polishing a wafer W, as illustrated in FIG. 1, in a state where the second arm 11*b* is positioned at the retracted position outside the polishing table 2 and the first arm 11*a* is positioned at the fluid ejection position inside the polishing table 2, the controller 15 transmits a control signal to the first valve 16*a* to eject slurry onto the polishing table 2 from thefirstnozzle(slurryejectionnozzle)12*a* provided on the first arm 11*a*, and the wafer (not illustrate) to be polished is pressed by the top ring 3 against the polishing table 2 and thus polished.

As illustrated in FIG. 8, after the polishing of the wafer W, the controller 15 transmits a control signal to the first valve 16*a* to stop the ejection of the slurry from thefirstnozzle12*a*. Then, on the basis of information acquired from the first rotation driver 14*a* and the second rotation driver 14*b*, the controller 15 checks the position of the first arm 11*a* and the position of the second arm 11*b* at the same time and determines whether the first arm 11*a* and the second arm 11*b* can be operated (step S10).

When the first arm 11*a* and the second arm 11*b* cannot be operated (step S10: NO), the controller 15 rechecks the position of the first arm 11*a* and the position of the second arm 11*b* on the basis of information acquired from the first rotation driver 14*a* and the second rotation driver 14*b* (step S10).

When the first arm 11*a* and the second arm 11*b* can be operated (step S10: YES), the controller 15 transmits a control signal to the second rotation driver 14*b* to move (turn) the second arm 11*b* from the retracted position to the fluid ejection position (step S11) and, at the same time, transmits a control signal to the first rotation driver 14*a* to move (turn) the first arm 11*a* from the fluid ejection position to the retracted position (step S13).

In the present embodiment, the first arm 11*a* and the second arm 11*b* are configured to be turnable around the same axis, and the controller 15 is capable of controlling the operation of the first rotation driver 14*a* and the operation of the second rotation driver 14*b* independently of each other. Thus, in turning the first arm 11*a*, it is not necessary to check the position of the second arm 11*b* so that the first arm 11*a* does not interfere with the second arm 11*b*. Also, in turning the second arm 11*b*, it is not necessary to check the position of the first arm 11*a* so that the second arm 11*b* does not interfere with the first arm 11*a*. Thus, the step of moving (turning) the first arm 11*a* from the fluid ejection position to the retracted position (step S13) and the step of moving (turning) the second arm 11*b* from the retracted position to the fluid ejection position (step S11) can be performed simultaneously. Compared to a comparative example, which will be described further below, the control sequence is simple, and the risk of interference between the first arm 11*a* and the second arm 11*b* can be reduced.

Next, as illustrated in FIG. 3, after the second arm 11*b* is positioned at the fluid ejection position inside the polishing table 2 (step S12), and the first arm 11*a* is positioned at the retracted position outside the polishing table 2 (step S14), the controller 15 transmits a control signal to the second valve 16*b* to jet a cleaning liquid (e.g., pure water) onto the polishing table 2 from each ejection orifice of the secondnozzle(atomizer)12*b* provided on the second arm 11*b*, thereby cleaning the polishing surface on the polishing table 2 (step S15).

In step S15, the controller 15 may transmit a control signal to the second rotation driver 14*b* to swing the second arm 11*b* at the swing angle θ2 (e.g., 1° to 45°). By jetting the second fluid from the secondnozzle(atomizer)12*b* while swinging the second arm 11*b*, the landing areas 17 can be allowed to overlap the remaining streaks 18 as illustrated in FIG. 7 even if the jet angle θ3 (refer to FIG. 5) decreases. Thus, it is possible to feed the second fluid to the entire surface of the polishing table 2 (with no gap) to maintain the entire surface cleaning.

Thereafter, the controller 15 transmits a control signal to the second valve 16*b* to stop the jet of the cleaning liquid from the second nozzle 12*b* to finish the cleaning of the polishing surface of the polishing table (step S16).

Next, on the basis of information acquired from the first rotation driver 14*a* and the second rotation driver 14*b*, the controller 15 checks the position of the first arm 11*a* and the position of the second arm 11*b* at the same time and determines whether the first arm 11*a* and the second arm 11*b* can be operated (step S20).

When the first arm 11*a* and the second arm 11*b* cannot be operated (step S20: NO), the controller 15 rechecks the position of the first arm 11*a* and the position of the second arm 11*b* on the basis of information acquired from the first rotation driver 14*a* and the second rotation driver 14*b* (step S20).

When the first arm 11*a* and the second arm 11*b* can be operated (step S20: YES), the controller 15 transmits a control signal to the second rotation driver 14*b* to move (turn) the second arm 11*b* from the fluid ejection position to the retracted position (step S21) and, at the same time, transmits a control signal to the first rotation driver 14*a* to move (turn) the first arm 11*a* from the retracted position to the fluid ejection position (step S23).

In the present embodiment, the first arm 11*a* and the second arm 11*b* are configured to be turnable around the same axis, and the controller 15 is capable of controlling the operation of the first rotation driver 14*a* and the operation of the second rotation driver 14*b* independently of each other. Thus, in turning the first arm 11*a*, it is not necessary to check the position of the second arm 11*b* so that the first arm 11*a* does not interfere with the second arm 11*b*. Also, in turning the second arm 11*b*, it is not necessary to check the position of the first arm 11*a* so that the second arm 11*b* does not interfere with the first arm 11*a*. Thus, the step of moving (turning) the second arm 11*b* from the fluid ejection position to the retracted position (step S21) and the step of moving (turning) the first arm 11*a* from the retracted position to the fluid ejection position (step S23) can be performed simultaneously. Compared to the comparative example, which will be described further below, the control sequence is simple, and the risk of interference between the first arm 11*a* and the second arm 11*b* can be reduced.

Next, as illustrated in FIG. 1, after the first arm 11*a* is positioned at the fluid ejection position inside the polishing table 2 (step S24), and the second arm 11*b* is positioned at the retracted position outside the polishing table 2 (step S22), polishing of the next wafer is performed.

(Comparative Example)

Figure 9:
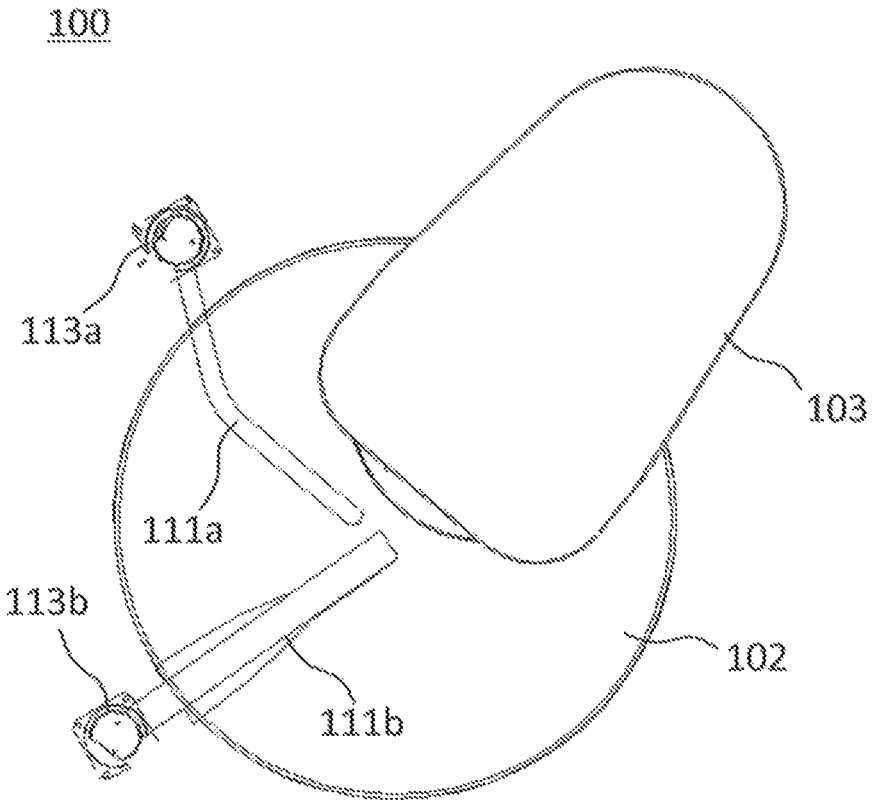
FIG. 9 is a plan view illustrating the schematic configuration of a polishing apparatus of a comparative example.
Figure 10:
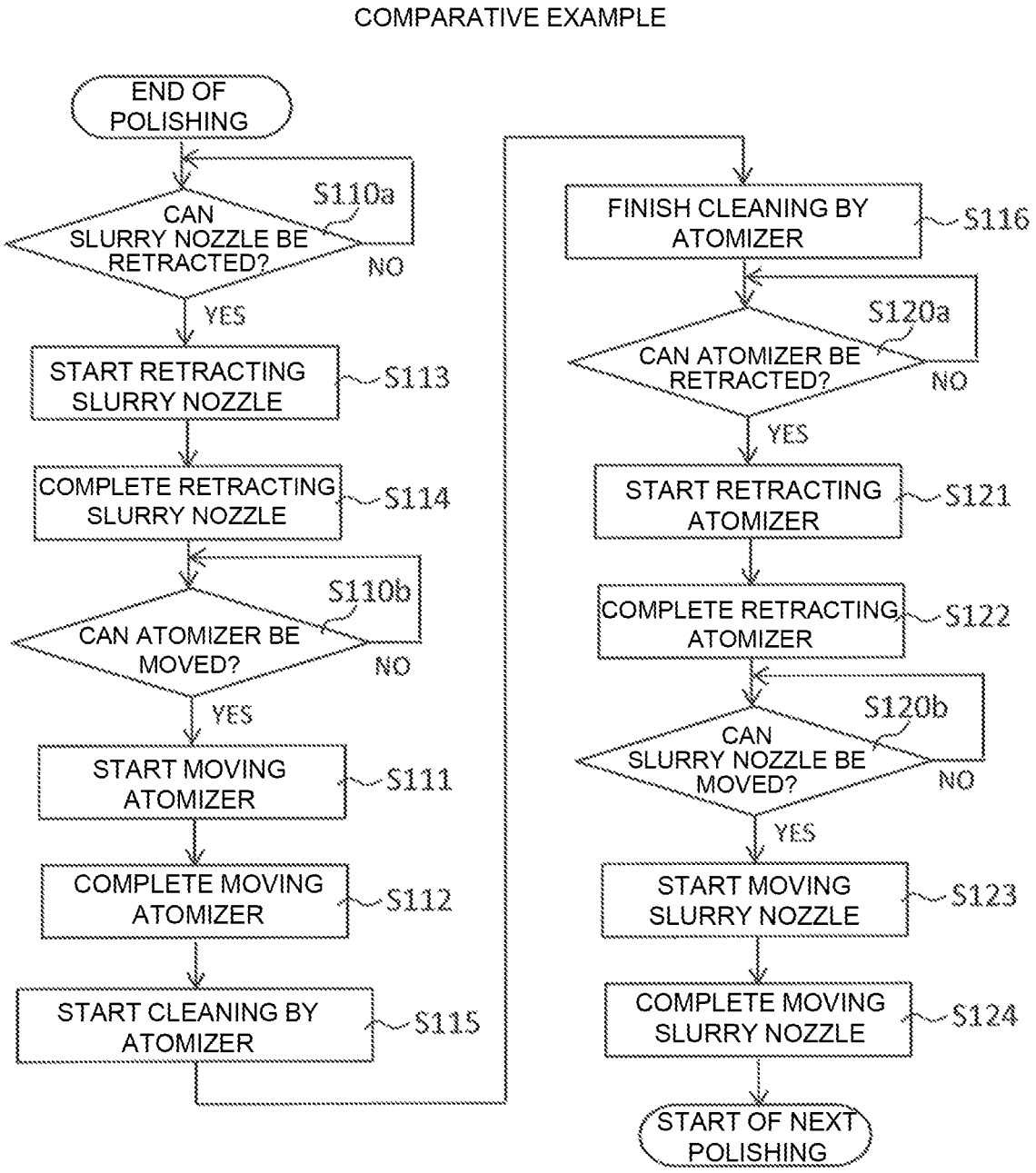
FIG. 10 is a flowchart illustrating an example of the operation of the polishing apparatus of the comparative example.

Next, as a comparative example, the operation of a polishing apparatus 100 including a first rotation shaft 113*a* and a second rotation shaft 113*b* which are not coaxially disposed (disposed at different positions) as illustrated in FIG. 9 will be described. FIG. 10 is a flowchart illustrating an example of the operation of the polishing apparatus 100 of the comparative example.

First, in polishing a wafer W, as illustrated in FIG. 9, in a state where a firstarm111*a* is positioned at a fluid ejection position inside a polishingtable102, slurry is ejected onto the polishing table 102 from a slurry ejection nozzle (not illustrated) provided on the firstarm111*a*, and the wafer (not illustrate) to be polished is pressed by a top ring 103 against the polishing table 102 and thus polished.

As illustrated in FIG. 10, after the polishing of the wafer W, the ejection of the slurry from the slurry ejection nozzle provided on the first arm 111*a* is stopped. Then, the position of a second arm 111*b* is checked, and it is determined whether the first arm 111*a* can be retracted without interfering with the second arm 111*b* (step S110*a*).

When the first arm 111*a* cannot be retracted without interfering with the second arm 111*b* (step S110*a*: NO), the position of the second arm 111*b* is rechecked (step S110*a*).

When the first arm 111*a* can be retracted without interfering with the second arm 111*b* (step S110*a*: YES), the first arm 111*a* is turned around the axis of the first rotation shaft 113*a* and thereby moved from the slurry ejection position to a retracted position (step S113).

Next, after the first arm 111*a* is positioned at the retracted position outside the polishingtable102 (step S114), the position of the first arm 111*a* is checked, and it is determined whether the second arm 111*b* can be moved to a cleaning liquid ejection position without interfering with the first arm 111*a* (step S110*b*).

When the second arm 111*b* cannot be moved without interfering with the first arm 111*a* (step S110*b*: NO), the position of the first arm 111*a* is rechecked (stepS110*b*).

When the second arm 111*b* can be moved without interfering with the first arm 111*a* (step S110*b*: YES), the second arm 111*b* is turned around the axis of the second rotation shaft 113*b* and thereby moved from the retracted position to the cleaning liquid ejection position (step S111).

Next, after the second arm 111*b* is positioned at the cleaning liquid ejection position inside the polishingtable102 (step S112), a cleaning liquid (e.g., pure water) is jetted onto the polishing table 102 from each ejection orifice of the atomizer provide on the second arm 111*b*, thereby cleaning a polishing surface on the polishing table 102 (step S115).

Thereafter, the jet of the cleaning liquid from the atomizer provided on the second arm 111*b* is stopped to finish the cleaning of the polishing surface of the polishingtable102 (step S116).

Next, the position of the first arm 111*a* is checked, and it is determined whether the second arm 111*b* can be retracted without interfering with the first arm 111*a* (step S120*a*).

When the second arm 111*b* cannot be retracted without interfering with the first arm 111*a* (step S120*a*: NO), the position of the first arm 111*a* is rechecked (stepS120*a*).

When the second arm 111*b* can be retracted without interfering with the first arm 111*a* (step S120*a*: YES), the second arm 111*b* is turned around the axis of the second rotation shaft 113*b* and thereby moved from the cleaning liquid ejection position to the retracted position (step S121).

Next, after the second arm 111*b* is positioned at the retracted position outside the polishingtable102 (step S122), the position of the second arm 111*b* is checked, and it is determined whether the first arm 111*a* can be moved to the slurry ejection position without interfering with the second arm 111*b* (step S120*b*).

When the first arm 111*a* cannot be moved without interfering with the second arm 111*b* (step S120*b:* NO), the position of the second arm 111*b* is rechecked (stepS120*b*).

When the first arm 111*a* can be moved without interfering with the second arm 111*b* (step S120*b:* YES), the first arm 111*a* is turned around the axis of the first rotation shaft 113*a* and thereby moved from the retracted position to the slurry ejection position (step S123).

Next, after the firstarm111*a* is positioned at the slurry ejection position inside the polishingtable102 (step S124), polishing of the next wafer is performed.

As described above, according to the present embodiment, as illustrated in FIGS. 1 and 2, since the first rotation shaft 13*a* and the second rotation shaft 13*b* are disposed coaxially with each other, the first arm 11*a* and the second arm 11*b* are turned around the same axis. This can minimize a space occupied by the first arm 11*a* and the second arm 11*b* turning above the polishing table 2, thereby leaving a space for installing a device other than thefirstnozzle12*a*andthesecondnozzle12*b* (for example, a dresser, a temperature control slider, or a pad cooling nozzle) on and above the polishing table 2.

Also, according to the present embodiment, since the operation of the first rotation driver 14*a* and the operation of the second rotation driver 14*b* can be controlled independently of each other, at least one of the first nozzle 12*a* and the second nozzle 12*b* can be retracted from the polishing table 2 at any timing by individually driving the first arm 11*a* and the second arm 11*b*. For example, in a case where the first nozzle 12*a* is a slurry ejection nozzle, and the second nozzle 12*b* is an atomizer, the atomizer 12*b* is retracted in advance out of the polishing table 2 in ejecting slurry from the slurry ejection nozzle 12*a* while swinging theswingarm11*a*. This prevents the operation range of the swingarm11*a* from being limited by interference with the atomizer 12*b* to enable the slurry to be dropped onto the entire surface of the pad and also prevents the slurry fed onto the polishing pad from being diluted with jetted water (water droplets)unpredictably dripping from the atomizer 12*b*. Thus, the polishing performance is improved.

Also, according to the present embodiment, the first arm 11*a* and the second arm 11*b* are disposed at the different height positions. Thus, the first arm 11*a* and the second arm 11*b* can be turned so as to cross each other (that is, so that one passes above (or below) the other). This makes it possible to retract each of the first nozzle 12*a* and the second nozzle 12*b* from the polishing table 2 at any timing (that is, retract one regardless of the position of the other). By retracting each of the first nozzle 12*a* and the second nozzle 12*b* out of the polishing table 2 at any timing, the preliminary preparation operations that are typical factors that reduce the polishing time (wafer processing time) (for example, the discharge of fluid (e.g., slurry) remaining inside the pipe) can be performed during the idle time. This reduces reduction in the polishing time (wafer processing time).

While the embodiment and modifications have been described above as examples, the range of the present technique is not limited the above-described embodiment and modifications, and changes/modifications can be made in accordance with the object within the range defined in the claims. Furthermore, the embodiment and modifications can be combined as appropriate without causing any inconsistency in processing details.

What is claimed is:

1. A liquid feeder comprising:

a first arm horizontally extending above a polishing table and having a first nozzle configured to eject a first fluid onto the polishing table;

a second arm horizontally extending above the polishing table and having a second nozzle configured to eject a second fluid onto the polishing table;

a first rotation shaft supporting a proximal end part of the first arm;

a second rotation shaft supporting a proximal end part of the second arm;

wherein the second nozzle is closer to the first rotation shaft and the second rotation shaft relative to the first nozzle;

a first rotation driver configured to rotate the first rotation shaft around an axis thereof to turn the first arm from a fluid feed position inside the polishing table to a retracted position outside the polishing table;

a second rotation driver configured to rotate the second rotation shaft around an axis thereof to turn the second arm from a fluid feed position inside the polishing table to a retracted position outside the polishing table; and a controller configured to control an operation of the first rotation driver and an operation of the second rotation driver, wherein the first rotation shaft and the second rotation shaft are disposed coaxially with each other, and the controller is capable of controlling the operation of the first rotation driver and the operation of the second rotation driver independently of each other.

2. The liquid feeder according to claim 1, wherein the first arm and the second arm are disposed at different height positions.

3. The liquid feeder according to claim 1, wherein the first fluid is one or more of an abrasive liquid, a chemical solution, water, nitrogen, and compressed air, and the second fluid is one or more of an abrasive liquid, a chemical solution, water, nitrogen, and compressed air.

4. The liquid feeder according to claim 1, wherein the first nozzle has a plurality of ejection orifices, and/or the second nozzle has a plurality of ejection orifices.

5. The liquid feeder according to claim 1, wherein the controller is capable of controlling ejection of the first fluid from the first nozzle and ejection of the second fluid from the second nozzle independently of each other.

6. The liquid feeder according to claim 1, wherein the controller is capable of feeding the first fluid from the first nozzle regardless of a position of the first arm and capable of feeding the second fluid from the second nozzle regardless of a position of the second arm.

7. The liquid feeder according to claim 1, wherein the controller is capable of ejecting the first fluid from the first nozzle while swinging the first arm and capable of feeding the second fluid from the second nozzle while swinging the second arm.

8. A polishing apparatus comprising the liquid feeder according to claim 1.

9. The polishing apparatus according to claim 8, wherein the first arm and the second arm are disposed at different height positions.

10. The polishing apparatus according to claim 8, wherein the first fluid is one or more of an abrasive liquid, a chemical solution, water, nitrogen, and compressed air, and the second fluid is one or more of an abrasive liquid, a chemical solution, water, nitrogen, and compressed air.

11. The polishing apparatus according to claim 8, wherein the first nozzle has a plurality of ejection orifices, and/or the second nozzle has a plurality of ejection orifices.

12. The polishing apparatus according to claim 8, wherein the controller is capable of controlling ejection of the first fluid from the first nozzle and ejection of the second fluid from the second nozzle independently of each other.

13. The polishing apparatus according to claim 8, wherein the controller is capable of feeding the first fluid from the first nozzle regardless of a position of the first arm and capable of feeding the second fluid from the second nozzle regardless of a position of the second arm.

14. The polishing apparatus according to claim 8, wherein the controller is capable of ejecting the first fluid from the first nozzle while swinging the first arm and capable of feeding the second fluid from the second nozzle while swinging the second arm.

* * * * *